US006264860B1

(12) United States Patent
Attar

(10) Patent No.: US 6,264,860 B1
(45) Date of Patent: Jul. 24, 2001

(54) HOUSINGLESS ABRASION RESISTANT PAVEMENT MARKER

(76) Inventor: Adil Attar, P.O. Box 3883, Ontario, CA (US) 91761

( * ) Notice: Subject to any disclaimer, the term of this patent is extended or adjusted under 35 U.S.C. 154(b) by 0 days.

(21) Appl. No.: 09/305,335

(22) Filed: May 3, 1999

Related U.S. Application Data

(63) Continuation-in-part of application No. 08/863,901, filed on May 27, 1997, now Pat. No. 5,927,897, which is a continuation-in-part of application No. 08/502,149, filed on Jul. 14, 1995, now abandoned.

(51) Int. Cl.[7] ..... B29D 11/00
(52) U.S. Cl. ..... 264/1.9; 264/81; 427/163.1
(58) Field of Search ..... 264/1.1, 1.7, 1.9, 264/81; 427/163.1; 404/12, 14, 16

(56) References Cited

U.S. PATENT DOCUMENTS 3,627,403 * 12/1971 Hedgewick .
4,070,095 * 1/1978 Suhr ..... 404/12
4,498,733 * 2/1985 Flanagan ..... 404/14
4,726,706 * 2/1988 Attar ..... 404/16
5,268,217 * 12/1993 Kimock et al. .
5,502,593 * 3/1996 Hedgewick ..... 404/14

* cited by examiner

*Primary Examiner*—Mathieu D. Vargot

(57) ABSTRACT

A housingless abrasion resistance reflective pavement marker is disclosed. The marker includes a housingless, flat topped body and at least one reflective member encapsulated in the marker's body during casting. The body can be made of abrasion and impact resistant curable resinous material filled with inert additives. The reflective member can be coated with abrasive resistance diamond like carbon film to enhance durability and retain longer reflectivity. The reflective member can have an inside surface divided into light reflecting cells. The reflective cells can be further protected by a variety of impact reducing raised ridges. Disclosed is a method for making housingless reflective pavement marker in an open face mold.

6 Claims, 2 Drawing Sheets

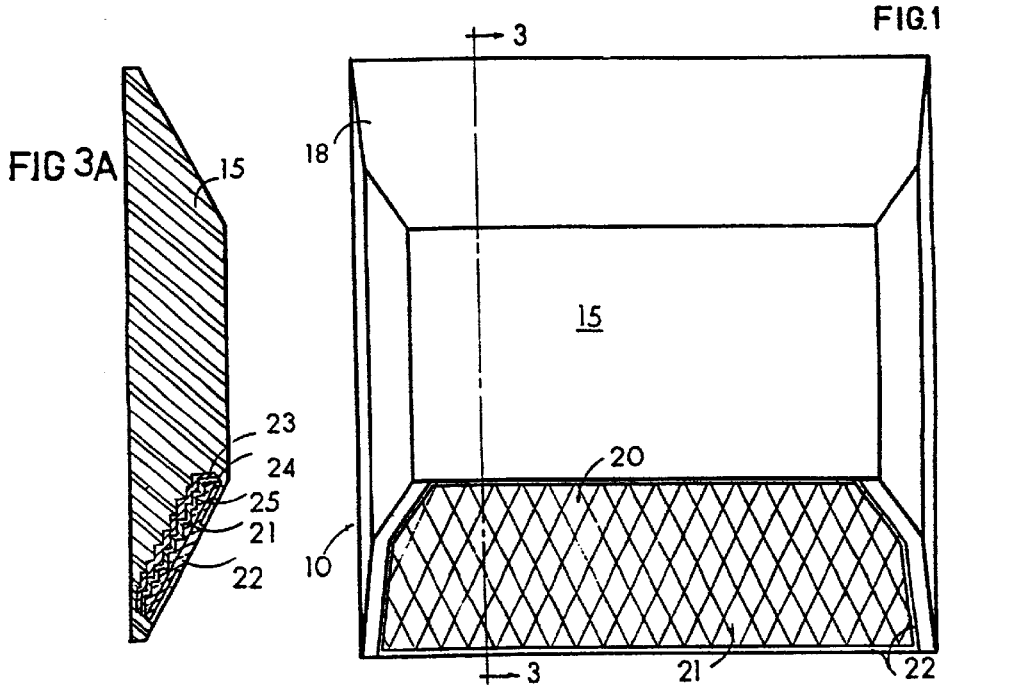
FIG.1
3
18
15
20
10
21
22
3
FIG 3A
15
23
24
25
21
22
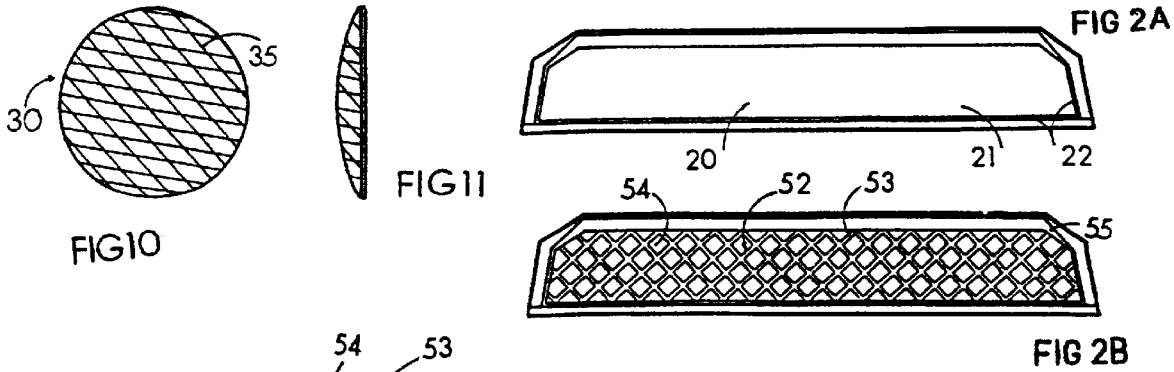
35
30
FIG10
FIG11
FIG 2A
20
21
22
54
52
53
55
FIG 2B
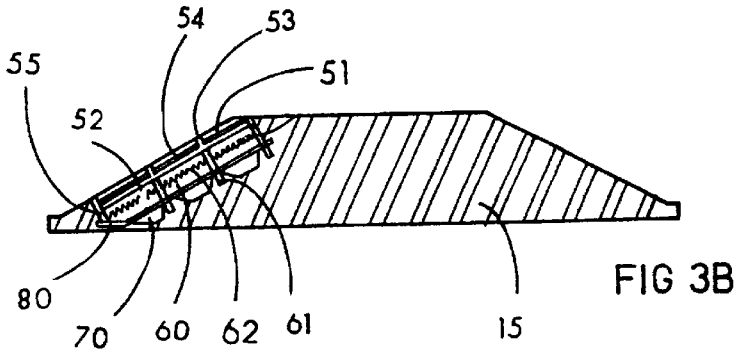
54
53
55
51
52
80
70
60
62
61
15
FIG 3B

HOUSINGLESS ABRASION RESISTANT PAVEMENT MARKER

This application is a continuation-in-part of serial number 08/863,901, filed May 27, 1997, now U.S. Pat. No. 5,297,897, which is a continuation-in-part of Ser. No. 08/502,149, filed Jul. 14, 1995, now abandoned.

BACKGROUND

The present invention is directed to reflective pavement marker without a housing or exterior shell. The reflective members are encapsulated in the housingless body itself This invention also relate to durable abrasion resistant reflective pavement markers. The primary use of this type of pavement marker is for roadway delineation. Pavement markers are commonly agglutinated to the roadway centerline, edgeline or as lane dividers and to serve as perimeter.

Reflective pavement markers generally made using a housing, which is some time referred to as a shell, this housing made of either acrylic, polycarbonate, ABS or other suitable thermoplastics materials. The housing act as a casing to enclose the resinous filler material that, after curing form the structural body of the pavement marker. The reflective member commonly placed either on one side or two opposite sides of the pavement marker facing on coming traffic, generally made as integral part of the housing or agglutinated to the housing then sealed with a metalized coating prior to being filled with the structural resinous body. Reflective members give nighttime visibility of the marker by reflecting headlights of the oncoming traffic.

A marker with a housing not only an added expense to the over all cost of such a product but also tend to chip away from the resinous body due to the severity of traffic impact and the difference in the coefficient of thermal expansions of the two materials, the housing and the resinous body. Additionally, sealing the cube-corner reflectors with a metallic sealer reduces reflectivity considerably.

Previously, attempts have been made to develop a housingless pavement markers. Pavement markers such as U.S. Pat. No. 4,498,733 to Flanagan, U.S. Pat. No. 4,875,798 to May and U.S. Pat. No. 4,208,090 to Heenan use an improved reflective members by using peripheral walls to provide supports and recesses at the bottom of the marker body that form hollowed base. However, unlike this invention, the reflective members are not protected by raised ridges on the outside surface that also help prevent buckling and lift-off the diamond like film coating for abrasion resistance without the need for prior coating of said surface with a polymeric materials. Other deficiency of markers such as 733 is that unless filling the hollowed base of the marker with a sealer material, there is considerable reduction in the adhesion parameter of the marker's base, thereby failure and dislodgement occur due to flexural stresses. The wetting parameter for adhesion of the present marker base to roadway can further be enhanced by spraying coarse sand on the planar base area of the marker body prior to the solidification o f the cast resinous body, as previously proven to be effective, as in U.S. Pat. No. 3,332,327 to Heenan, which is referenced herein. Thus, a need exist for an inexpensive yet have high structural strength and functional reflective marker that solve the problem of housing, having durable reflective members due to very high abrasion resistance diamond like carbon film coating, daytime and night time visibility and full planar base without recesses for durable agglutination to the roadway.

SUMMARY

The present invention satisfies this need by providing a reflective pavement marker that dispenses altogether the use of housing or shell. The present invention comprises a rigid housingless body and a reflective member encapsulated in the inert filled curable resinous body. The body of the marker has a flat top surface and textured planar base surface. The reflective member having inside surface divided by partition walls into several reflective cells, each cell having multiple of cube-corner reflective elements. Each partition wall have a holding pin. The entire reflective cells sealed with a backing sheet allowing the holding pins to protrude outside the backing sheet from a corresponding slots within the backing sheet. The outside planar surface of the reflective member can be integrally divided by a variety of abrasion and impact reducing raised ridges. A reflective cell can be rhomboid, hexagonal or rectangular in shape. Further protection for the reflective cells can be achieved by encapsulating the sealed reflective member in the curable resinous body, leaving only the outside planar surface with raised ridges exposed to roadway environment. The durability of the reflective member can be enhanced further by having the outside planar surface with raised ridges coated with diamond like carbon film, by vapor coating process, for scratch resistance and longer retroreflectivity. The primary objective of the present invention is to provide a housingless reflective pavement marker having at least one reflective member being encapsulated in the curable resinous body with only the outside surface of the reflective member exposed to outside environment, the marker body can have textured planar base surface for better adhesion to the pavement. Still another objective of the present invention is to provide an abrasion resistant pavement marker with at least one reflective member having an inside surface divided into reflective cells by partition and load carrying walls, each wall having a holding pin extending beyond the apices of the cube-corner reflective elements within a cell, said reflective cells being sealed with a backing sheet, said sealed reflective cells and protruding holding pins being encapsulated by the curable resinous body without the need to agglutinate or sonic weld the reflective member. It is yet another desired objective of the present invention is having the raised ridges on the outside surface of the reflective member act as load transferer and to prevent the dislodgement of an abrasion resistant diamond like film coating of said outside surface of the reflective member for scratch resistance.

BRIEF DESCRIPTION OF THE DRAWINGS

The accompanying drawings describe one of the preferred embodiments of this invention. The drawings are not to scale. Referenced numbers used to like elements throughout, wherein FIG. 1 is a plan view of one embodiment of the housingless pavement marker in accordance to this invention, with one encapsulated reflective member.

FIG. 2A is an elevation view of the pavement marker shown in FIG. 1.

FIG. 2B is another elevation view of the pavement marker shown in FIG. 1 having A non metalized reflective member 52.

FIG. 3A is a cross-sectional view through line 3—3 in FIG. 1.

FIG. 3B is a cross section view taken along line 3—3 of the pavement marker shown in FIG. 1 with the reflective member, as in FIG. 2B.

FIG. 10 is a plan view of another embodiment of a marker of the present invention having spherical shaped body.

FIG. 11 is an elevation view of the marker of FIG. 10.

DETAILED DESCRIPTION

Figure 8:
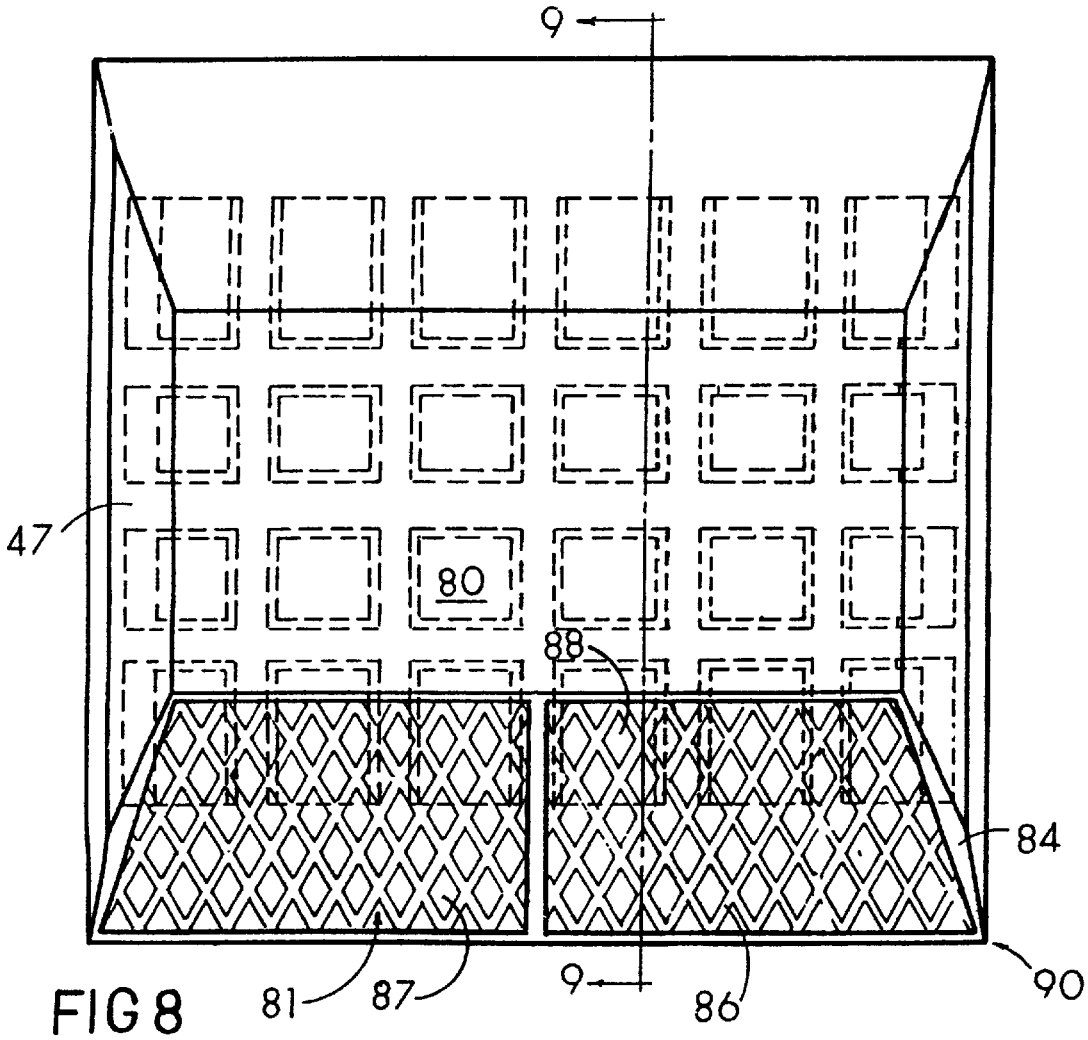
FIG. 8 is a plan view of another embodiment of a marker of the present invention.

FIGS. 1 through 3B represent a preferred embodiment of a reflective marker 10. Marker 10 comprises a housingless, flat top body 15 and at least one reflective member 52. The reflective member 52 is encapsulated in the body 15 during casting process, only the outer planar surface 54 of the reflective member 52 remain exposed to roadway environment. Body 15 is made of a curable resinous material. The resinous material can contain substantial amount of inert additives. The inert additives significantly improve the structural strength of the cured resinous body 15. The curable resinous material can be chosen from a wide variety of suitable materials, such as epoxy, polyester or polyurethane resins. Such resinous materials are durable and can be filled with inexpensive inert materials and easily processed at or near room temperature. These resinous materials also have high resistance to the degrading effects of long-term environmental exposure.

Epoxy and polyurethane are preferred when automated marker production methods are used because of their rapid curing and superior structural values, including high flexural and impact strength. The resinous material preferably contains substantial amount of inert additives such as silica, calcium carbonate, talc, ground glass or combination thereof, such additives, besides enhancing the structural and abrasion strengths, it also reduces cost considerably. The reflective member 52 can be made of transparent plastic with high optical value such as polymethacrylate resin. The reflective member 52 can have an outside planar surface 54 divided by diamond, hexagonal or rectangular shaped abrasion reducing and load transferring raised ridges 53. Ridges 53 can act as trusses to transfer and distribute impact load within body 15. Raised ridges 53 are integral part of the reflective member 52 and can be slightly raised above the outside planar surface 54. Periphery walls 55 serve to tightly hold the outside planar surface 54, face down onto a corresponding raised portion of an open face mold during casting of body 15.

The inside surface of reflective member 52 can be divided into rhombic, hexagonal or rectangular shaped cells 60 corresponding to planar surface 54 on the outside surface of said reflective member 52. Each cell 60 can have several cube-corner reflective elements 62. Cells 60 can be integrally isolated from each other by partition walls 61, each wall 61 having a holding pin 70 that extend beyond apices of the cube-corner reflective elements 62 and pierce through corresponding holes within a backing sheet 80 that seal the entire inside cells of the reflective member 52. Holding pins 70 used to transfer impact load from the raised ridges 53 that define the outside planar surface 54 directly to the structural body 15. Several suitable types of cube-corner reflective elements (lenses) are available to use for this marker, as disclosed in U.S. Pat. No. 3,712,706 to Stamm, U.S. Pat. No. 3,924,929 to Holmen et al, U.S. Pat. No. 4,588,258 to Hoopman, U.S. Pat. No. 4,726,706 to Attar, and U.S. Pat. No. 4,498,733 to Flanagan, all of which have been incorporated herein by reference in their entireties.

Reflective member 52 can be placed in a mold that has at least one inclined side with slightly raised portion so that periphery walls 55 snugged firmly onto said raised portion of the mold, thereby protecting the outside planar surface 54 during casting process of body 15. Prior to placing the reflective member in the mold, the outside surface 54 can be coated with an abrasion resistant diamond like carbon film 51 for enhanced abrasion and scratch resistance, utilizing the process of vacuum evaporation with ion enhanced deposition method or other scratch resistant coating methods that utilizes vapor deposition processes. By condensation of energetic Ionized carbon particles, a layer of super hard thin film bombard the outside surface 54 thereby agglutinating a thin layer of this diamond like film onto said outside surface 54. Several remarkable properties can be achieved via this carbonaceous thin film coating, including: extremely hard surface, low surface friction, high reflective index, resistant to ultra violate rays and total transparency. Several attempt have been made to solve pavement marking abrasion problems, as detailed in U.S. Pat. No. 4,340,319 to Johnson et al, who attempted to improve abrasion resistant by agglutinating thin sheet of glass on the reflective face and U.S. Pat. No. 4,797,024 to Forrer who discloses a polymer (liquid) coating that is chemically bonded to the outside surface of the reflective member. These methods have the tendencies to reduce the reflective index and in some cases distort retro reflectivity. Although the hardness of this hard coating by far exceed all other abrasion resistant coatings, it has a very high compressive stress within the carbon layers.

This may cause serious problems, because these coated layers may buckle or tend to lift off from the substrate when dynamic load such as from automotive tire is applied. Other arts attempted to solve lift off and buckling of the diamond like carbon layer by pre coating the substrate with several polymer layers to chemically bond the substrate and the diamond like carbon layer, as in U.S. Pat. No. 5,268,217 to Kimock. This art utilizes raised ridges 53 on the outside surface 54 of the reflective member 52 to avoid buckling and lift off.

Any desired color of the marker can be achieved by pigmentation of the material that form the reflective members or the body 15. A pigmented gel-coat can also be applied to the open face mold surface before casting the resinous material to form body 15.

Figure 9:
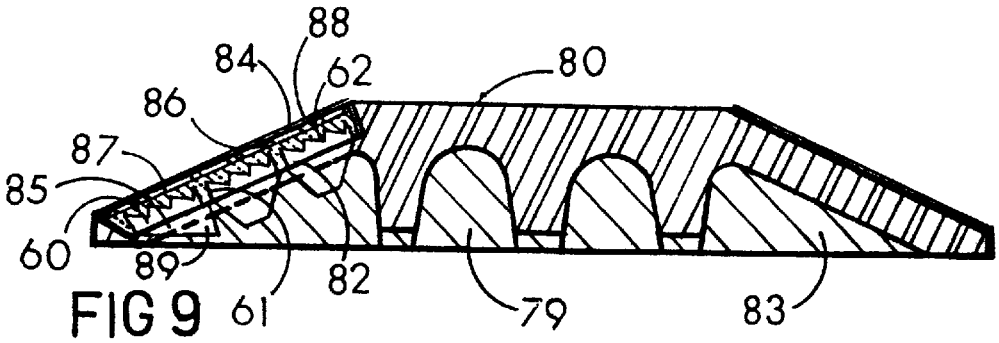
FIG. 9 is a cross sectional view taken along line 9—9 of the marker in FIG. 8.

Another preferred embodiment of the invention is FIGS. 8 and 9.

Marker 90 comprises of a rigid body 80. Body can be made of organic resinous material such as ABS or polycarbonate and a reflective member 81. Reflective member 81 can be embedded in the corresponding, slightly recessed side 82, bounded by raised walls 84, either on one side or two opposite sides of body 80. Body 80 can have multi-angular sides 47 designed to lower the vehicular impact force.

Reflective member 81 can have an outside surface with abrasion resistant and load transferring ridges 86. Ridges 86 help define the planar surfaces of rhombic, hexagonal or square shaped cells 87. Cells 87 can be adopted to intercept light. The outside surface of reflective member 81 can be coated with abrasion resistance diamond-like carbon film

88. The inside surface of reflective member 81 can be divided into either rhombic, hexagonal or square shaped cells 60 corresponding to planar cells 87 on the outside of reflective member 81. Each cell 60 can have multiple of reflective elements 62.

Figure 4A:
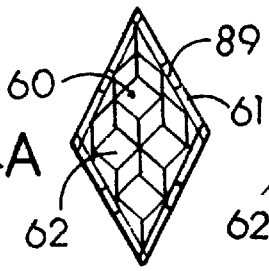
FIG. 4A is a view of a rhombic shaped reflective cell with multiple reflective elements.
Figure 4B:
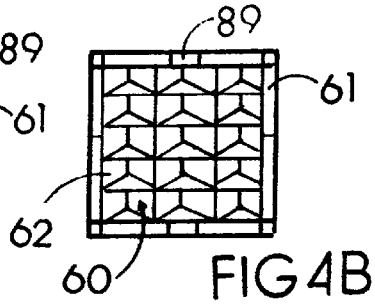
FIG. 4B is a view of a square shaped reflective cell with multiple reflective elements.
Figure 4C:
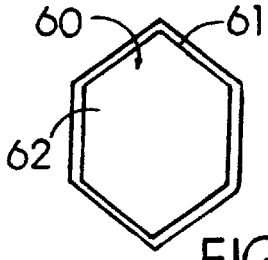
FIG. 4C is a view of a hexagonal shaped cell with reflective elements.

A preferred embodiment of cell 60 shown in FIGS. 4A, 4B and 4C. Cells 60 can be Isolated from each other by partition and load carrying walls 61. Each wall 61 having a holding pin 89 that extend beyond the raised corners of all the three mutually intersecting surfaces of the reflective elements 62 within each cell. By inserting the reflective member 81 into the corresponding recessed side 82, the holding pins 89 will go through each corresponding slot 85. Body 80 can have hollow recesses 83 within the bottom portion of body 80. Hollow recesses can be caped or filled with a sealer material needed to seal and strengthen portion of the holding pins 89 that are inserted through the corresponding slots 85 within the recessed sides 82. The reflective marker of the present invention can be of any size and shape that would conform to any desired roadway specifications. The most commonly acceptable sizes of a truncated pavement marker for roadway usage have bottom surface dimensions of 4 by 4 inches, 2.75 by 4.5 inches or 3 by 5 inches with any specified height. A preferred shape of the marker is a truncated pyramid having flat top with height, between 0.60 to 0.70 inch. This form assumes a low profile on the roadway surface and helps distribute and transfer impact loads evenly within the structural body 15. The present invention includes within its scope a method for making a reflective pavement marker.

A suitable method can include the steps of, firstly selecting a curable resinous material, the appropriate percentage and combination of the inert additives, selecting a reflective member coated with abrasion resistance diamond like carbon film, selecting a mold with at least one inclined surface with raised portion corresponding to the size and shape of the reflective member that need to snug on said raised surface before casting body 15. After the resinous material is cured, the reflective member become securely encapsulated in the hardened resinous body. The present pavement marker has several important advantages among which are the followings:

1. Improved abrasion and impact resistance due to the high inert additives within the resinous body without the low abrasion resistant plastic housing.
2. Superior protection of the reflective members due to being encapsulated and slightly recessed in the body structure.
3. Superior scratch resistance due to coating the outside surface of the reflective member with diamond like film.
4. Less expensive because it eliminate the plastic housing, sonic welding and the process of metalizing the cube corner reflective elements.

Although the present invention has been described in considerable details with reference to certain preferred versions or embodiments thereof, other versions are possible, for example, the marker can have a base with more than four sides, it can have a rectangular shaped base with rumble top portion, it can have a housing with at least one reflective member having an outside surface without raised ridges and the outside surface being coated with diamond like carbon film. Additionally, a wide variety of inert additives can be used to enhance the structural strength. Therefore, the spirit and scope of the appended claims should not necessarily be limited to the description of the preferred versions contained herein.

What is claimed is:

1. A method for making a housingless pavement marker comprising the steps: forming a reflective member having an outside planar surface bounded by periphery walls, said outside surface integrally divided by raised ridges, and an inside surface with plurality of diamond, hexagonal or rectangular shaped cells, each of said cells having a multiple of cube corner reflective elements, said cells isolated from each other by partition walls, each wall having a holding pin protruding through a corresponding shaped hole within a sonically welded backing sheet, said backing sheet sealing the entire back of the reflective cells forming an air gap between apices of the cube corner reflective elements within a cell and said backing sheet and casting a housingless pavement marker body made of a curable resinous material around the reflective member to form the housingless pavement marker.

2. A method as set forth in claim 1 further comprising the step of coating the outside planar surface of the reflective member with a carbon film coating layer utilizing vapor deposition methods, said vapor deposited coating adhering to said outside planar surface for abrasion resistance and to retain longer retroreflectivity of said reflective member.

3. A method as set forth in claim 1 further comprising the additional step of selecting an open face mold for casting the housingless marker body, said mold having at least one inclined side with a raised portion corresponding to the size and shape of the outside surface of the reflective member so that the periphery walls surrounding said outside surface snug onto said raised portion of the open face mold prior to casting the housingless pavement marker body.

4. A method as set forth in claim 1, further comprising the additional step of selecting a curable resinous material with inert additives to cast said housing less body, said material having consistent patch proportion to achieve stability and maximum structural strength after curing.

5. A method as set forth in claim 4 further comprising the step of dispensing the curable resinous material with the inert additives in the mold thereby encapsulating the back portion of the reflective member sealed with a backing sheet, periphery walls and the protruding holding pins.

6. A method as set forth in claim 5 further comprising the step of removing the cured and solidified pavement marker body together with the encapsulated reflective member from the open face mold as to obtain a housingless reflective pavement marker.

* * * * *